US006039617A

United States Patent [19]

Nakamura

[11] Patent Number: 6,039,617

[45] Date of Patent: Mar. 21, 2000

[54] TILT CYLINDER DEVICE FOR OUTBOARD MOTOR

[75] Inventor: Tamotsu Nakamura, Saitama, Japan

[73] Assignee: Showa Corporation, Saitama, Japan

[21] Appl. No.: 09/188,924

[22] Filed: Nov. 9, 1998

[30] Foreign Application Priority Data

Mar. 24, 1998 [JP] Japan ..... 10-076285

[51] Int. Cl.[7] ..... B63H 21/26

[52] U.S. Cl. ..... 440/61; 440/53; 440/65

[58] Field of Search ..... 440/61, 65, 63, 440/53

[56] References Cited

U.S. PATENT DOCUMENTS

| | | | |
|---|---|---|---|
| 5,261,843 | 11/1993 | Tsujii et al. | 440/61 |
| 5,389,018 | 2/1995 | Funami | 440/61 |
| 5,529,519 | 6/1996 | Nakamura et al. | 440/61 |

FOREIGN PATENT DOCUMENTS 6210876 4/1976 Japan .

*Primary Examiner*—S. Joseph Morano
*Assistant Examiner*—Lars A. Olson
*Attorney, Agent, or Firm*—Dvorak & Orum

[57] ABSTRACT

A tilt cylinder device has an exterior oil passage 61 outside a cylinder 51 for bringing oil chambers S6 and S7 into communication with each other, the exterior passage 61 is provided with a pump 72 and a control valve 73. A piston 13 is formed with a communication passage 34 for bringing oil chambers S6 and S7 into communication with each other. The communication passage 34 is provided with a first relief valve 15 which opens when a pressure in the rod side oil chamber S6 exceeds a set pressure. A hollow piston rod 14 is provided therein with a delay mechanism 16 for delaying the closing operation of the first relief valve 15 by pushing a valve body 15*b* of the first relief valve 15 in its valve opening direction for a predetermined time period after the relief valve 15 is opened.

2 Claims, 10 Drawing Sheets

TILT CYLINDER DEVICE FOR OUTBOARD MOTOR

BACKGROUND OF THE INVENTION

1. Field of the Invention

The present invention relates to an improvement of a tilt cylinder device for an outboard motor.

2. Description of the Related Art

The state of the art is shown in Japanese Patent Application Publication No. 62-10876 (MARINE PROPULSION UNIT).

Such structure prevents excessive pressure load from being applied to a cylinder piston assembly or its hydraulic fluid circuit which tilts a propulsion assembly, when a marine propulsion unit collides against an obstacle in the water. As shown in FIGS. 1 and 2 of this publication, this conventional marine propulsion unit comprises, a member 13 mounted to a boat body 15, a swivel bracket 19 vertically rotatably mounted to the member 13, a propulsion unit assembly 17 mounted to the swivel bracket 19, an inclined cylinder piston assembly 33 having an inclined cylinder 35, an inclined piston 41 and a piston rod 43, provided between the member 13 and the swivel bracket 19, a pump 73 provided outside the inclined cylinder piston assembly 33 for supplying a pressurized fluid, a control valve 75 connected to the pump 73 for controlling a flow of the pressurized fluid which is to be supplied to the inclined cylinder piston assembly 33, and an automatic releasing assembly 151 for gradually constricting the inclined cylinder 35 which lowers the propulsion unit assembly 17 to the original position, when the propulsion unit assembly 17 collides against an obstacle in the water and is moved upward.

In the above prior art, the pump 73, since the control valve 75 and the automatic releasing assembly 151 are provided outside the inclined cylinder piston assembly 33 as separate members, it is necessary to secure a large space between the boat body 15 and the propulsion unit assembly 17, and there is an undesirable probability that a handling efficiency of the propulsion unit assembly 17 may be reduced.

SUMMARY OF THE INVENTION

It is therefore an object of the present invention to provide a compact tilt cylinder device for an outboard motor.

To achieve this object, according to the present invention, there is provided a tilt cylinder device for an outboard motor mounted to a stern, and which can be stopped at an arbitrary position when the outboard motor is swung from its in-use position to its stand-by position, the tilt cylinder device being interposed between the stern and the outboard motor in order to moderate a shock applied to the outboard motor during running, and wherein a piston from which a hollow piston rod is extended in one direction is movably inserted in a cylinder. A hollow piston rod-side oil chamber and opposite-side oil chamber which is opposite from the hollow piston rod-side oil chamber are defined in the cylinder by the piston. An exterior oil passage is provided outside the cylinder for bringing the two oil chambers into communication with each other, and the exterior oil passage is provided with a pump for generating a hydraulic pressure. A control valve for controlling pressure and the flowing direction of hydraulic fluid flowing downstream of the pump and to selectively supply hydraulic fluid to the two oil chambers so as to move the piston toward the hollow piston rod-side oil chamber or the opposite-side oil chamber. The piston is formed with a communication passage for bringing the two oil chambers into communication with each other. The communication passage is provided with a relief valve which opens when pressure in the hollow piston rod-side oil chamber exceeds a set pressure. The hollow piston rod is provided with a delay mechanism for delaying closing operation of the relief valve by pushing a valve body of the relief valve in its valve opening direction for a predetermined time period after the relief valve is opened.

The present invention further provides a tilt cylinder device for an outboard motor in which an outboard motor is mounted to a stern, whereby the outboard motor can be stopped at an arbitrary position when the outboard motor is swung from its in-use position to its stand-by position, the tilt cylinder device being interposed between the stern and the outboard motor in order to moderate a shock applied to the outboard motor during running, and wherein a piston from which a hollow piston rod is extended in one direction is movably inserted into a cylinder. A hollow piston rod-side oil chamber and opposite-side oil chamber which is opposite from the hollow piston rod-side oil chamber are defined in the cylinder by the piston, and an accumulator chamber is provided outside the cylinder for also serving as a volume compensating chamber for compensating the volume of oil which flows in and out through only the opposite-side oil chamber as the hollow piston rod is advanced or withdrawn, the piston being formed with a communication passage for bringing the two oil chambers into communication with each other. The communication passage is provided with a relief valve which opens when a pressure in the hollow piston rod-side oil chamber exceeds a set pressure. The hollow piston rod is provided therein with a delay mechanism for delaying a closing operation of the relief valve by pushing a valve body of the relief valve in its valve opening direction for a predetermined time period after the relief valve is opened. The tilt cylinder device includes an exterior operating rod capable of forcibly opening and closing the relief valve through the delay mechanism.

BRIEF DESCRIPTION OF THE DRAWINGS

The present invention will be understood more fully from the detailed description given hereinbelow and from the accompanying drawings of the preferred embodiments of the invention, which are given by way of example only, and are not intended to limit the present invention.

In the drawings.

DESCRIPTION OF THE PREFERRED EMBODIMENT

An embodiment of the present invention will be explained with reference to the accompanying drawings.

Figure 1:
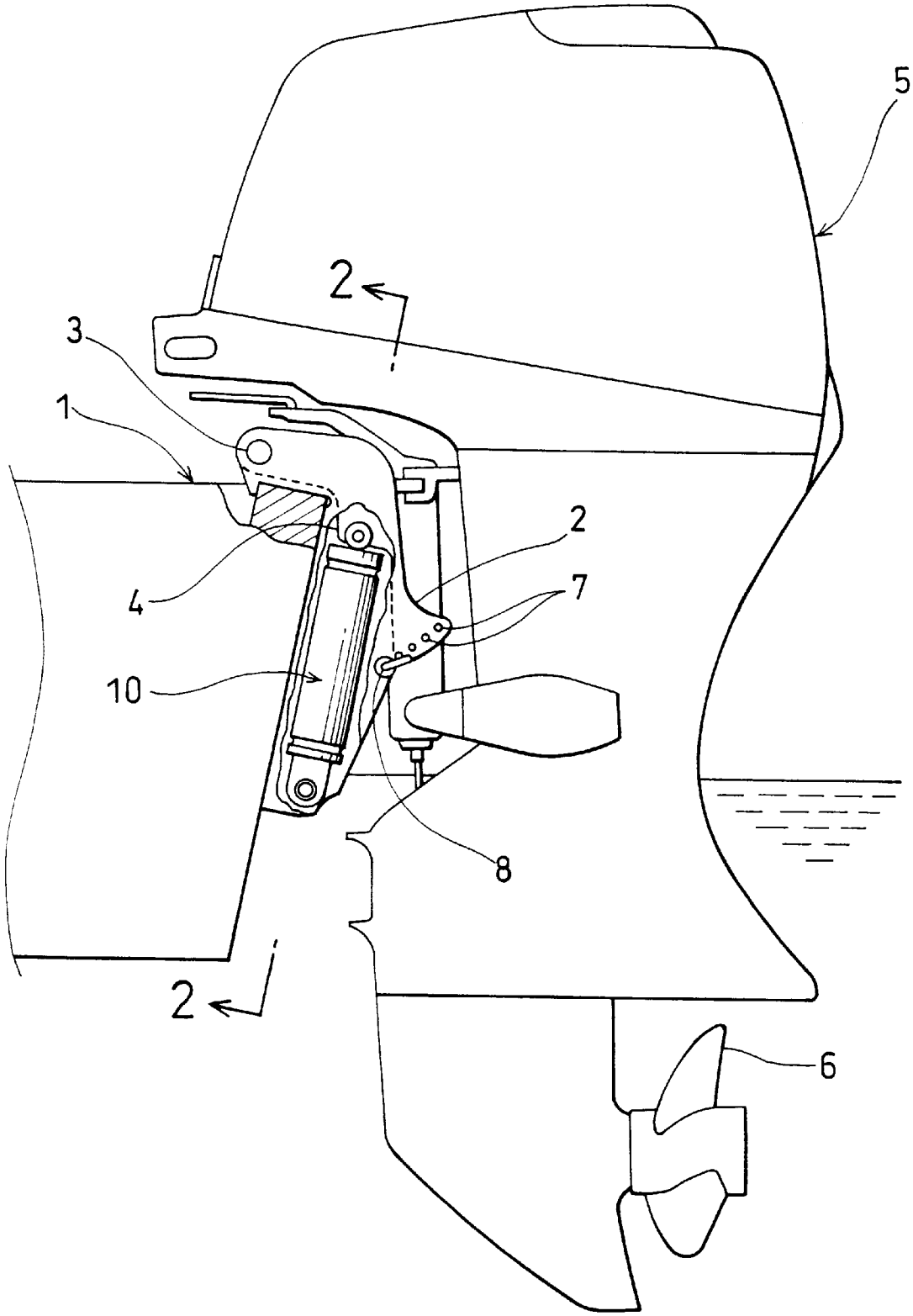
FIG. 1 is a side view showing a state where the tilt cylinder device of the present invention is mounted between a boat stern and an outboard motor.

FIG. 1 is a side view showing a state where a tilt cylinder device of the present invention is mounted between a boat stern and an outboard motor. Stern bracket 2 is attached to stern 1, a swivel bracket 4 is mounted on the stern bracket 2 so that the swivel bracket 4 can rotate vertically around a horizontal shaft 3. An outboard motor 5 is mounted on the swivel bracket 4, and a tilt cylinder device 10 is provided between the stern bracket 2 and the swivel bracket 4. The reference number 6 denotes a propeller of the outboard motor 5, the reference numbers 7 denote position adjusting holes at rear portions of the stern bracket 2. The reference number 8 denotes a stopper pin for adjusting a tilt-down position of the outboard motor by selectively inserting the stopper pin into one of the position adjusting holes 7.

Figure 2:
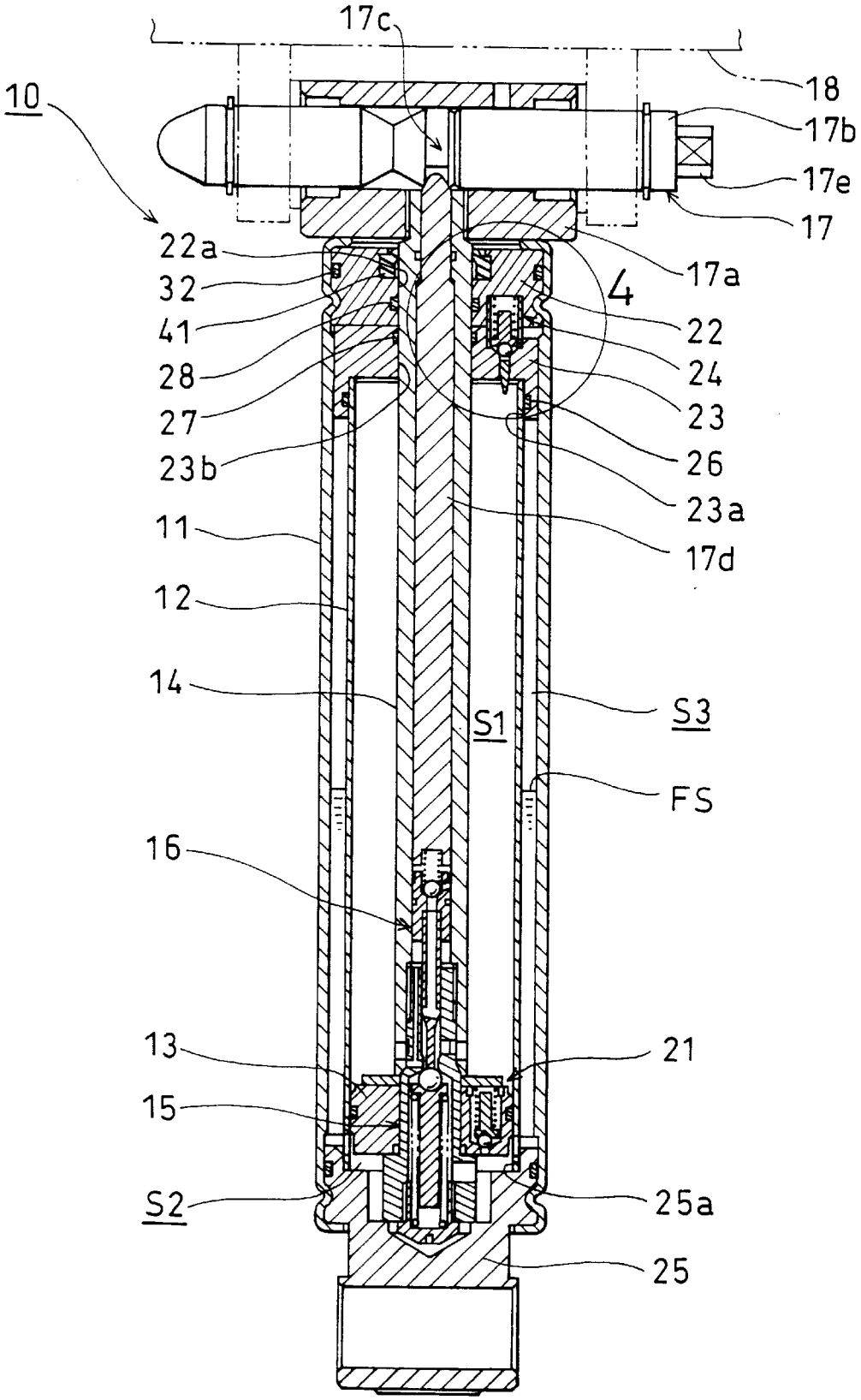
FIG. 2 is a sectional view taken along the line 2—2 in FIG. 1.

FIG. 2 is a sectional view taken along the line 2—2 in FIG. 1. The tilt cylinder device 10 has an outer cylinder 11, an inner cylinder 12 disposed inside of the outer cylinder 11, a piston 13 vertically movably inserted into the inner cylinder 12, a hollow piston rod 14 mounted to the piston 13, a first relief valve 15 functioning as an on-off valve provided in the hollow piston rod 14, a delay mechanism 16 for delaying the timing of the closing of the first relief valve 15, and a manual operation mechanism 17 for opening and closing the first relief valve 15 through the delay mechanism 16. Upper mounting member 18 connects an upper portion of the manual operation mechanism 17 to the swivel bracket 4 (see FIG. 1) so that the manual operation mechanism 17 can rotate.

Tilt cylinder device 10 has a second relief valve 21 mounted in the piston 13, with rod guide 22 as a closing member supporting the hollow piston rod 14 at an upper portion of the outer cylinder 11, an upper block 23 for holding an upper portion of the inner cylinder 12 at a lower portion of the rod guide 22, a vent valve 24 sandwiched between the rod guide 22 and the upper block 23, and a lower block 25 mounted to the outer cylinder 11 for holding a lower portion of the inner cylinder 12.

The reference number 22*a* denotes a penetration hole of the rod guide 22 through which the hollow piston rod 14 passes. Reference number 23*a* denotes a recess of the upper block 23. Reference number 23*b* denotes an opening in the upper block 23 through which the hollow piston rod 14 passes. Reference number 25*a* denotes a recess of the lower block 25, and reference numbers 26 and 32 denote O-rings while 27, 28 denote O-rings as sealing members.

The tilt cylinder device 10 further has upper and lower oil chambers S1 and S2 defined in the inner cylinder 12 by the piston 13. Accumulator S3 acts as an accumulator chamber between the outer and inner cylinders 11 and 12 for also serving as a volume compensation chamber.

The manual operation mechanism 17 has a base 17*a* connected to an upper portion of the hollow piston rod 14. A camshaft 17*b* is rotatably mounted in the base 17*a*. A cam portion 17*c* is formed in the camshaft 17*b* and actuates rod 17*d* for vertical movement in the hollow piston rod 14. The reference number 17*e* denotes a hexangular end for mounting a handle which is not shown.

The lower block 25 also serves to mount the lower end of the tilt cylinder device 10 to the stern bracket 2 (see FIG. 1).

Gas having a pressure higher than atmospheric pressure is sealed in an upper portion of the accumulator S3, and a lower portion thereof is filled with hydraulic fluid. The accumulator S3 is connected with the lower oil chamber S2 through oil holes 12*a*, 12*a* (see FIG. 3) at a lower end of the inner cylinder 12.

When the hollow piston rod 14 is inserted into the inner cylinder 12 by the accumulator S3, hydraulic fluid in an amount corresponding to the volume of the hollow piston rod 14 moves into the accumulator S3 from the upper and lower oil chambers S1 and S2 so that oil level FS rises, and when the hollow piston 14 is pulled out from the inner cylinder 12, the hydraulic fluid in an amount corresponding to a volume of the hollow piston rod 14 moves from in the accumulator S3 into the upper and lower oil chambers S1 and S2 so that the oil level FS is lowered, thereby compensating the volume variation of the hydraulic fluid in the upper and lower oil chambers S1 and S2.

The assembling method of the tilt cylinder device 10 will be explained below.

(1) The operation rod 17*d* of the manual operation mechanism 17 and the delay mechanism 16 are inserted into the hollow piston rod 14, and the hollow piston rod 14 is connected to the piston 13 by the first relief valve 15.

(2) The components assembled in (1) are inserted in the inner cylinder 12.

(3) An upper end of the hollow piston rod 14 is inserted into the opening 23*b* of the upper block 23, and an upper end of the inner cylinder 12 is inserted into the recess 23*a* of the upper block 23 through the O-ring 26. In this case, the upper end of the inner cylinder 12 and the recess 23*a* are set to form a loose fit.

(4) The components assembled in (3) are inserted into the outer cylinder 11, and the vent valve 24 is attached to the upper block 23.

(5) An upper end of the hollow piston rod 14 is inserted into the opening 22*a* of the rod guide 22, the rod guide 22 is inserted into the outer cylinder 11, and the vent valve 24 is sandwiched between the upper block 23 and the rod guide 22.

(6) The manual operation mechanism 17, except the operation rod 17*d*, is connected to the upper end of the hollow piston rod 14.

(7) The lower block 25 is inserted into the outer cylinder 11, and the lower end of the inner cylinder 12 is inserted into the recess 25*a* of the lower block 25.

(8) The lower portion of the outer cylinder 11 is fixed to an outer peripheral surface of the lower block 25 by bending inwardly, and the upper portion of the outer cylinder 11 is fixed to an outer peripheral surface of the rod guide 22 by bending inwardly.

Before assembling, the O-ring 27, the O-rings 28 and 32, the O-rings 37 and 38 (FIG. 3), the O-ring 39 (FIG. 3) and a dust seal 41 (FIG. 4A) should be mounted to the upper block 23, the rod guide 22, the piston 13, the lower block 25 and the rod guide 22, respectively.

With the above described operations, the assembling of the tilt cylinder device 10 is completed.

In this manner, the tilt cylinder device 10 is formed of piston 13 with hollow piston rod 14, the inner cylinder 12 vertically movably accommodating the piston 13 and having upper and lower oil chambers S1 and S2 defined by the piston 13. The outer cylinder 11 surrounds inner cylinder 12. The communication passage 34 for connecting the upper and lower oil chambers S1 and S2 is formed in the piston 13 and the hollow piston rod 14. Disposed in the communication passage 34 is the first relief valve 15 which can be operated from outside and prevents the oil from flowing from the lower oil chamber S2 to the upper oil chamber S1, and which serves as a shock absorbing valve for allowing oil to flow from the upper oil chamber S1 to the lower oil chamber S2 when pressure in the upper oil chamber S1 exceeds a set pressure, thereby absorbing a shock. The accumulator S3 is formed between the outer cylinder 11 and the inner cylinder 12 for serving as the volume compensating chamber to control volume of oil passing in and out through the lower oil chamber S2 so as to follow the in-and-out movement of the hollow piston rod 14. Therefore, the space occupied by the tilt cylinder device 10 is reduced, and the length required for mounting the tilt cylinder device 10 is also reduced. Further, any external outside communication passage to be connected to outside from the outer and inner cylinders 11 and 12 is unnecessary.

Therefore, a flexibility in design for mounting the tilt cylinder device 10 between the stern 1 and the outboard motor 5 is enhanced and, the flexibility in design of shapes of the stern bracket 2, the swivel bracket 4 and the outboard motor 5 to be mounted to the opposite ends of the tilt cylinder device 10 is also enhanced.

Further, this tilt cylinder device 10 itself is compact, the length required for mounting the same is reduced and therefore, it is easy to transport or handle the device 10 at the time of maintenance or for assembling.

Furthermore, since an external communication passage is unnecessary, it is unnecessary to route the pipe or to cast or mold a communication passage integrally in the cylinder. The tilt cylinder device 10 can be assembled easily and the cost is reduced.

From the above reasons, the cost required for the structure of outboard motor 5 including the tilt cylinder device 10 and brackets 2 and 4 can be reduced.

In addition, since the outer cylinder 11 and the inner cylinder 12 are assembled by inserting the inner cylinder 12 into the lower blocks 23 and 25, and the outer cylinder 11 is bent inwardly to the rod guide 22 and the lower block 25 as described with reference to FIG. 2, and since the inner cylinder 12 is provided at its lower end with opening 12*a* (see FIG. 3), the inner cylinder 12 can be roughly fitted to the lower block 25. Since the O-ring 26 is used on the upper end of the inner cylinder 12, the inner cylinder 12 can be loosely fitted to the upper block 23, which facilitates the assembling operation, and the number of assembling steps can be reduced.

Furthermore, no distortion is generated in the outer cylinder 11 if welding is employed.

Therefore, with the structures of the outer and inner cylinders 11 and 12, the cost can be lowered, and a quality can be enhanced.

Figure 3:
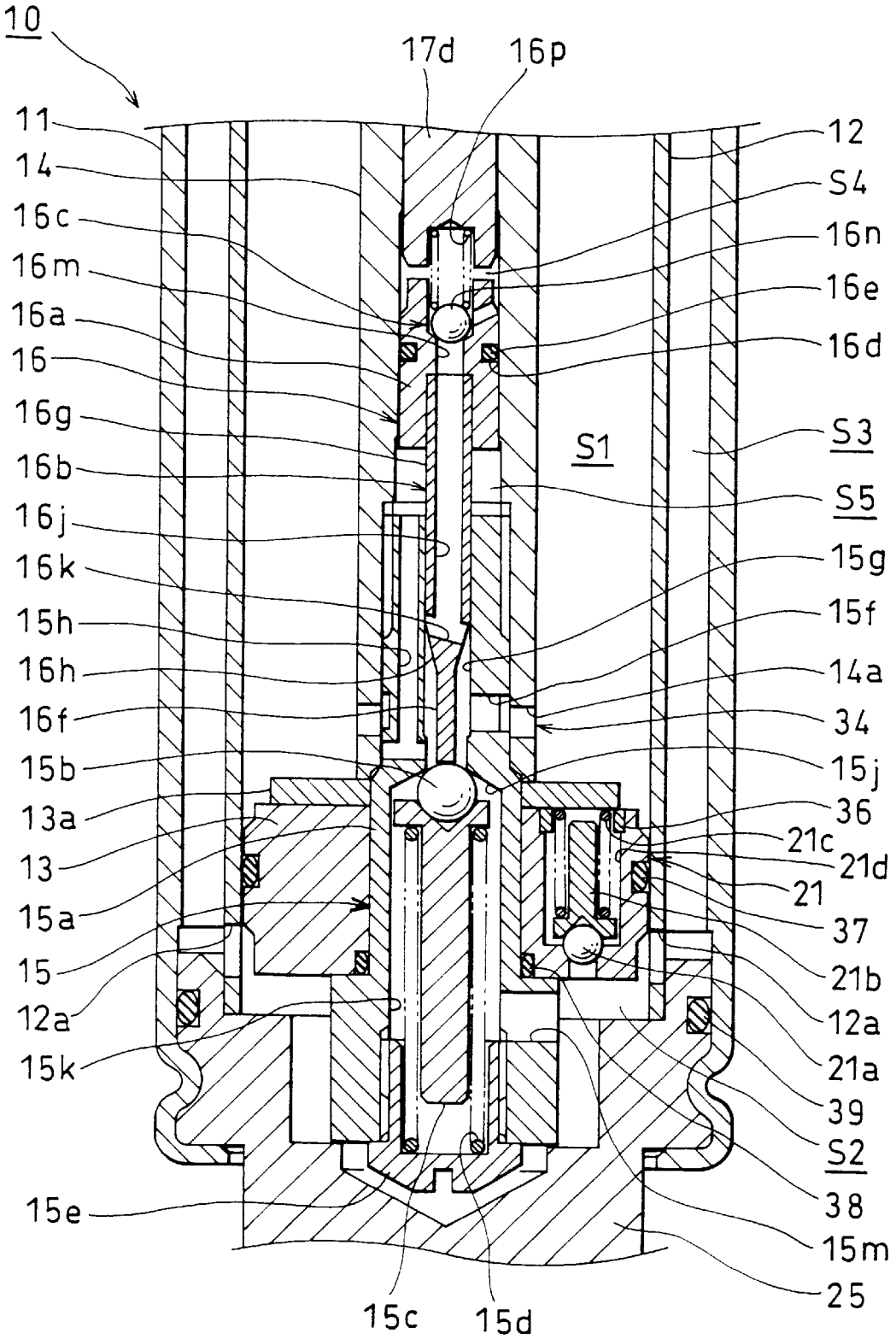
FIG. 3 is an enlargement of a lower portion of the tilt cylinder device shown in FIG. 2.

FIG. 3 is an enlarged sectional view of a lower portion of the tilt cylinder device of the present invention. The piston 13 includes a plate 13*a* between the piston 13 itself and the hollow piston rod 14 for holding an upper end of the second relief valve 21.

The hollow piston rod 14 includes a first oil passage 14*a* for connecting outer and inner peripheral portions with each other.

The piston 13 and the hollow piston rod 14 include the communication passage 34 for connecting the upper and lower oil chambers S1 and S2. The communication passage 34 is provided at its intermediate portion with the first relief valve 15.

The first relief valve 15 has a valve case 15*a* also serving as a valve seat connected to an inner periphery of the hollow piston rod 14 by a screw. A valve body 15*b* is provided in the valve case 15*a*. A spring 15*d* presses at its upper end of the valve body 15*b* through a retainer 15*c*. A lower lid 15*e* supports a lower end of the spring 15*d* and closes a lower portion of the valve case 15*a*.

The valve case 15*a* has a first lateral oil passage 15*f* provided on an upper side surface of the valve body 15*b*, and a first vertical oil passage 15*g* opened above the valve body 15*b*, and a second vertical oil passage 15*h* having a lower portion connecting with a side of the first vertical oil passage 15*g* and having an upper portion opened into the hollow piston rod 14. The valve case also has a valve seat portion 15*j*, a valve chamber 15*k* for accommodating the valve body 15*b*, the retainer 15*c* and the spring 15*d*, and a second lateral oil passage 15*m* for inter-connecting the valve chamber 15*k* and the lower oil chamber S2.

The communication passage 34 has the first oil passage 14*a* of the hollow piston rod 14, an inner periphery of the hollow piston rod 14 and an inner periphery of the piston 12.

The delay mechanism 16 comprises a free piston 16*a* slidably inserted within the hollow piston rod 14, a pin 16*b* integrally formed with a lower portion of the free piston 16*a* for depressing the valve body 15*b* of the first relief valve 15, and a third relief valve 16*c* incorporated in an upper portion of the free piston 16*a*.

The free piston 16*a* is provided at its outer periphery with a ring groove 16*d*, and a back-up ring 16*e* is mounted to the ring groove 16*d*. The back-up ring 16*e* includes a slit (not shown) serving as an orifice opening in a vertical direction.

The pin 16*b* has a small-diameter portion 16*f*, a large-diameter portion 16*g* and a tapered portion 16*h* connecting the small-diameter portion 16*f* and a large-diameter portion 16*g*, and includes a vertical passage 16*j* opened at an upper end of the large-diameter portion 16*g*. The tapered portion 16*h* includes an inclined passage 16*k* for bringing a lower end of the vertical passage 16*j* and an outer peripheral portion of the tapered portion 16*h* into communication with each other.

The large-diameter portion 16*g* of the pin 16*b* is slidably inserted in the first vertical oil passage 15*g* of the valve case 15*a*.

In the third relief valve 16*c*, the free piston 16*a* also serves as a valve seat, and the lower end of the spring 16*p* presses a valve body 16*n* in its closing direction against an intermediate portion of the oil passage 16*m* which connects from the vertical passage 16*j* of the pin 16*b* to the outer periphery of the free piston 16*a*.

An upper end of the spring 16*p* is abutted against a lower end of the operation rod 17*d* in the manual operation mechanism 17 (see FIG. 2).

The hollow piston rod 14 is provided with an upper oil chamber S4 between the free piston 16*a* and the operation rod 17*d*, and a lower oil chamber S5 between the free piston 16*a* and the valve case 15*a*.

In the second relief valve 21, the piston 13 also serves as a valve case and a valve seat. The second relief valve 21 comprises a valve body 21*a*, a spring 21*c* for pressing the valve body 21*a* through a retainer 21*b* downward, i.e., in its closing direction, a valve chamber 21*d* accommodating the valve body 21*a*, the retainer 21*b* and the spring 21*c*, and an oil passage (not shown) leading from the valve chamber 21*d* to the upper oil chamber S1. The reference number 36 denotes a ring for positioning an upper end of the spring 21*c*, and the reference numbers 37, 38 and 39 denote O-rings.

Figure 4A:
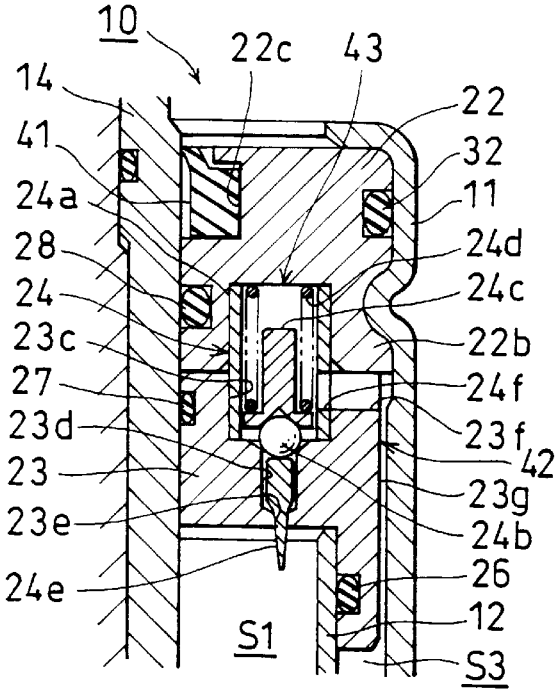
FIGS. 4A to 4D are views illustrating a vent valve of the invention.
Figure 4B:
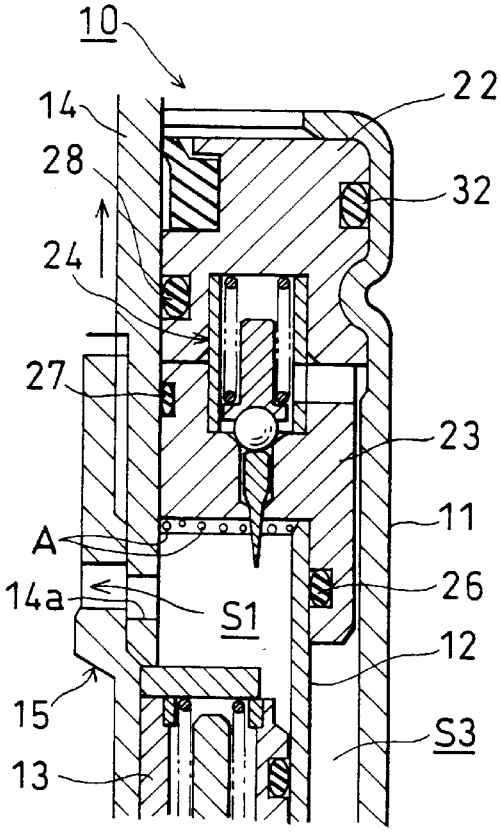
Figure 4C:
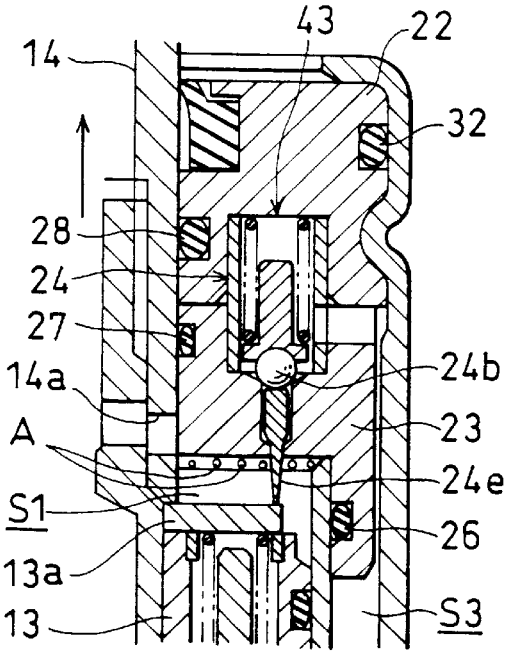
Figure 4D:
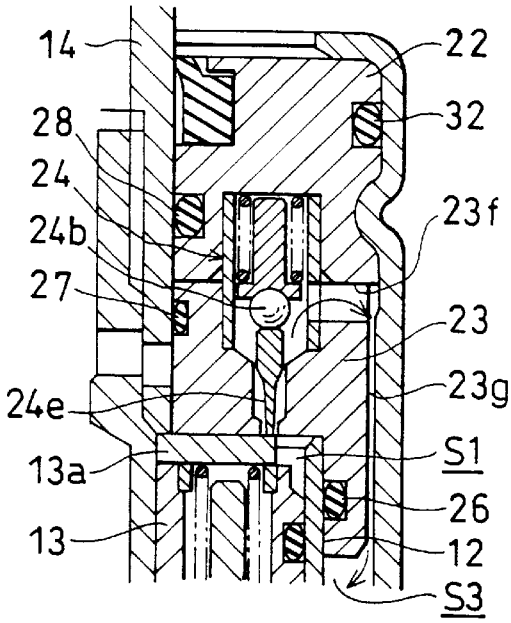

FIGS. 4A to 4D show a vent valve of the present invention, wherein FIG. 4A is an enlarged sectional view of a portion indicated by 4 in FIG. 2, and showing a state where the vent valve is closed. FIG. 4B shows a state where the piston rises halfway, FIG. 4C shows a state where a plate is abutted against a pushrod, and FIG. 4D shows a state where the vent valve is opened and the piston rises to the uppermost position.

In FIG. 4A, the rod guide 22 is provided at its lower portion with a recess 22*b* opened downwardly, and at its upper portion with a recess 2*c* for accommodating a dust seal 41.

The upper block 23 includes a recess 23*c* upwardly opened at an upper portion of the upper block 23, a large-diameter opening 23*d* and a small-diameter opening 23*e* for connecting a lower portion of the recess 23*c* and the inner cylinder 12, a lateral oil passage 23*f* leading from the recess 23*c* to the outer periphery, and a vertical oil passage 23*g* leading from the lateral oil passage 23*f* to the accumulator S3. The vertical oil passage 23*g* may be formed using a clearance between the inner periphery of the outer cylinder 11 and the outer periphery of the upper block 23.

The vent valve 24 comprises a valve case 24*a* fitted to a recess 22*b* of the rod guide 22 and a recess 23*c* of the upper block 23, a valve body 24*b* pressed against a lower end of the recess 23*c* which serves as a valve seat, a spring 24*d* depressing, at its lower end, the valve body 24*b* into its closing direction through a retainer 24*c*, and a pushrod 24*e* vertically movably inserted into the large-diameter opening 23*d* and the small-diameter opening 23*e* of the upper block 23. The reference number 24*f* denotes a penetration opening passing through an inner periphery to an outer periphery of the valve case 24*a*.

The small-diameter opening 23*e*, the large-diameter opening 23*d*, the recess 23*c*, the penetration opening 24*f*, the lateral oil passage 23*f* and the vertical oil passage 23*g* form an opening 42 connecting the upper portion of the inner cylinder 12 and the accumulator S3.

The recess 23*c* of the upper block 23, the valve case 24*a*, the valve body 24*b*, the retainer 24*c*, the spring 24*d*, and the recess 22*b* of the rod guide 22 form a fourth relief valve 43.

Since the vent valve 24 is disposed between the rod guide 22 and the upper block 23 in this manner, the vent valve 24 can be mounted easily. Bolts and nuts for mounting the vent valve 24 are unnecessary, and it is unnecessary to use fasteners so costs will be reduced.

The operation of the above described vent valve 24 will be explained next.

In FIG. 4A, if air A (see FIG. 4B) is mixed in the upper oil chamber S1 when the tilt cylinder device 10 is assembled, the lower block 25 shown in FIG. 2 is fixed, the first relief valve 15 is opened by the manual operation device 17 for connecting the upper and lower oil chambers S1 and S2 with each other, and the hollow piston rod 14 and the piston 13 are slowly lifted up as shown in FIG. 4B.

At that time, the hydraulic fluid in the upper oil chamber S1 passes through the first oil passage 14*a* of the hollow piston rod 14 and the first relief valve 15, and reaches into the lower oil chamber S2 (see FIG. 3).

In FIG. 4C, the hollow piston rod 14 and the piston 13 are further lifted up, the first oil passage 14*a* of the hollow piston rod 14 moves to the side of the upper block 23, and the plate 13*a* of the piston 13 abuts against the lower end of the pushrod 24*e* of the vent valve 24 just before the first oil passage 14*a* is closed.

Then, the upper end of the pushrod 24*e* abuts against the valve body 24*b*.

In FIG. 4D, if the piston 13 is further lifted upwardly, the pushrod 24*e* depresses the valve body 24*b* and the vent valve 24 starts to open. Therefore, air A (see FIG. 4C) in the upper oil chamber S1 escapes from the vent valve 24 into the accumulator S3 through the lateral oil passage 23*f* and the vertical oil passage 23*g* of the upper block 23.

Lifting movement of the piston 13 is continued until the plate 13*a* of the piston 13 abuts against the upper block 23.

As described above, in FIG. 4A, the opening 42 is formed between the upper portion of the inner cylinder 12 and the accumulator S3, and the vent valve 24 is provided an intermediate portion of the opening 42 and includes the pushrod 24*e* abutting against the lifted piston 13 and then moving the fourth relief valve 43 for releasing air A (see FIG. 4B) from the upper portion of the inner cylinder 12 into the accumulator S3 through the pushed and opened valve body 24*b*. That is, the piston 13 is lifted upwardly, the piston 13 is abutted against the pushrod 24*e*, the fourth relief valve 43 is opened to release air A (see FIG. 4B) in the upper portion of the inner cylinder 12 into the accumulator S3. As compared with the conventional device in which a number of steps are repeated for releasing air accumulated in the cylinder such as a step of reciprocating the air within the piston many times and a step for turning the tilt cylinder device upside down at the time of assembling the tilt cylinder device, the vent valve 24 can be opened only by pulling up the piston 13, and air is then removed easily.

Therefore, the number of air releasing steps can be decreased, the quality of the tilt cylinder device 10 can be enhanced, and the costs of manufacture can be reduced.

During the above described air releasing steps, even if air A (see FIG. 4C) in the upper oil chamber S1 enters the first relief valve 15 (see FIG. 3) or the lower oil chamber S2 (see FIG. 3), if a step of depressing the piston 13 is added to the above described steps and such steps are repeated several times, air A (see FIG. 4C) in the first relief valve 15 or the lower oil chamber S2 is moved into the accumulator S3 through the passage 12*a* provided at the lower end of the inner cylinder 12 during the step of depressing the piston 13 and therefore, there is no problem.

In a state where the vent valve 24 shown in FIG. 4A is closed, the upper portion of the inner cylinder 12, i.e., the upper portion of the upper oil chamber S1 and the upper portion of the accumulator S3 are out of communication because of the O-rings 26, 27, 28 and 32 shown in FIG. 2.

The O-ring 27 provided in the penetration opening 23*b* of the upper block 23 and the O-ring 28 provided in the penetration opening 22*a* of the rod guide 22 are not subjected to many strokes, and these O-rings tightly seal the hollow piston rod 14 while sliding.

Since O-rings 28 and 27 as sealing members which seal the clearance between the hollow piston rod 14 and the penetration openings 22*a* and 23*b* with respect to the rod guide 22 and the upper block 23 as closing members which have penetration openings 22*a* and 23*b* into which the hollow piston rod 14 passes through, and for closing the upper portion of the inner cylinder 12, when the vent valve 24 is not operated, the communication between the upper portion of the inner cylinder 12, i.e., the upper oil chamber S1 and the upper portion of the accumulator S3 is cut off. Therefore, the hydraulic fluid in the upper portion of the inner cylinder 12 and the accumulator S3 is not interconnected.

Therefore, a tilt lock state which is the essential function of the tilt cylinder device 10 can be maintained.

The manual operation of the above described tilt cylinder device 10 will be explained next.

Figure 5B:
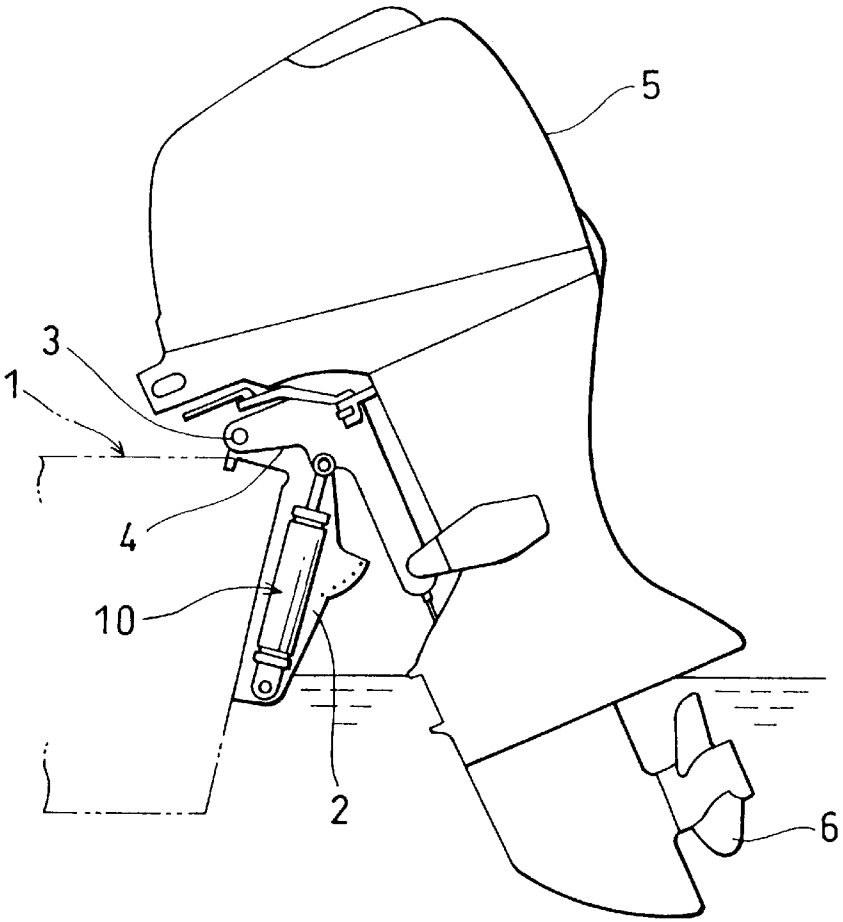
FIGS. 5A and 5B are views for explaining a manual operation of the tilt cylinder device of the invention.
Figure 5A:
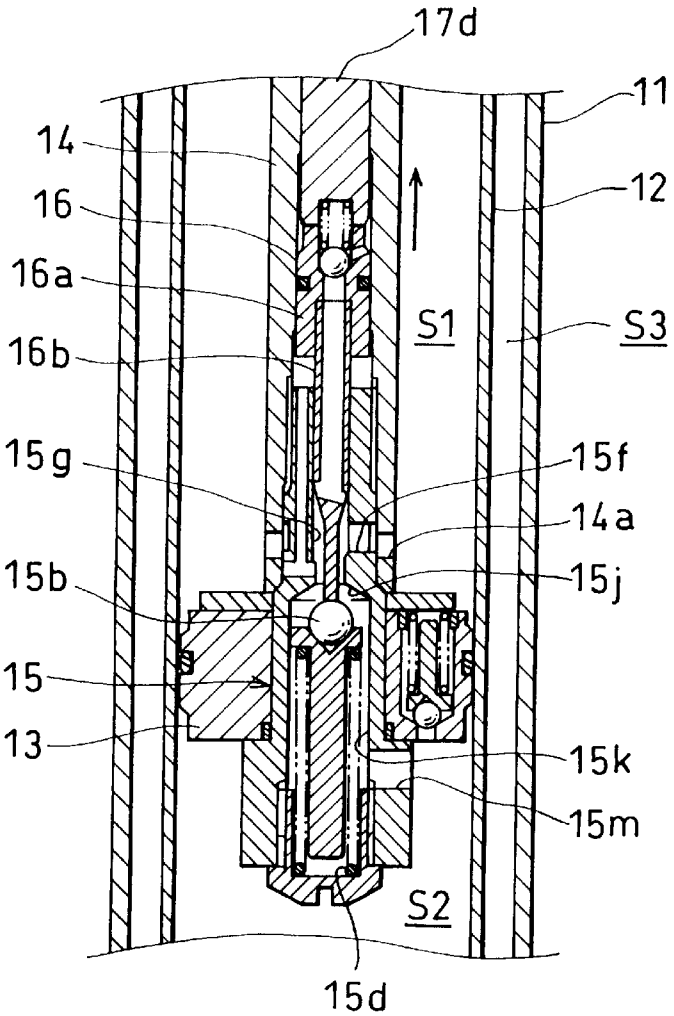

FIGS. 5A and 5B are views explaining the manual operation of the tilt lock device of the invention, in which FIG. 5A shows a state where the first relief valve 15 is opened, and FIG. 5B shows a tilt state of the outboard motor.

For example, when the boat advances in shallow water, it is necessary to tilt up the outboard motor 5 so the lower end of the outboard motor 5 does not strike the bottom as shown in FIG. 5B.

In such a case, in FIG. 2, a handle is put on the hexangular end 17*e* of the camshaft 17*b* of the manual operation device 17, and is rotated.

With this operation, the operation rod 17*d* is lowered by the cam portion 17*c* of the camshaft 17*b*.

In FIG. 5A, by lowering the operation rod 17*d*, a lower end of the operation rod 17*d* abuts against the free piston 16*a* of the delay device 16, and the pin 16*b* is lowered to push down the valve body 15*b* of the first relief valve 15. With this operation, the first relief valve 15 is opened, the upper oil chamber S1 is brought into communication with the lower oil chamber S2 through the first oil passage 14*a* of the hollow piston rod 14, the first lateral oil passage 15*f* of the first relief valve 15, the first vertical oil passage 15*g*, the valve chamber 15*k* and the second lateral oil passage 15*m*, so that the hollow piston rod 14 and the piston 13 can move vertically.

In FIG. 5B, the outboard motor 5 is inclined upward through a desired angle by a manual operation while maintaining the state shown in FIG. 5A.

At that time, since a tension force is applied to the tilt cylinder device 10, the piston 13 shown in FIG. 5A rises, and pressure in the upper oil chamber S1 is increased. Therefore, the hydraulic fluid in the upper oil chamber S1 flows into the lower oil chamber S2 through the first oil passage 14*a* of the hollow piston rod 14, the first lateral oil passage 15*f* of the first relief valve 15, the first vertical oil passage 15*g*, the valve chamber 15*k* and the second lateral oil passage 15*m*.

At that time, since the gas pressure in the accumulator S3 assists the extension of the tilt cylinder device 10 (see FIG. 5B), the above described tilting up operation can be carried out, with ease.

After that, the camshaft 17*b* of the manual operation mechanism 17 shown in FIG. 2 is again rotated to rise the operation rod 17*d*.

With these operations, the operation rod 17*d* is separated from the free piston 16*a* as shown in FIG. 5A, and the pin 16*b* is separated from the valve body 15*b*.

With this operation, the valve body 15*b* engages the valve seat 15*j* by the resilient force of the spring 15*d*, and the first relief valve 15 is closed.

Therefore, the hydraulic fluid cannot flow between the upper and lower oil chambers S1 and S2, the piston 13 cannot move vertically, and the tilt lock state is established.

With such an operation, the boat can advance in the shallow. When landing the boat, the outboard motor 5 (see FIG. 5B) is inclined substantially horizontally by manual operation of the above described tilt cylinder device 10 (see FIG. 2), and such state can be maintained.

To return the outboard motor 5 to a substantially vertical state as shown in FIG. 1, the first relief valve 15 may be opened and closed by the above described manual operation. At that time, the hydraulic fluid in the inner cylinder 12 flows through the passages in a direction opposite to that in which the outboard motor 5 is tilted up.

The automatic operation of the above described tilt lock device 10 will be explained next.

Figure 6B:
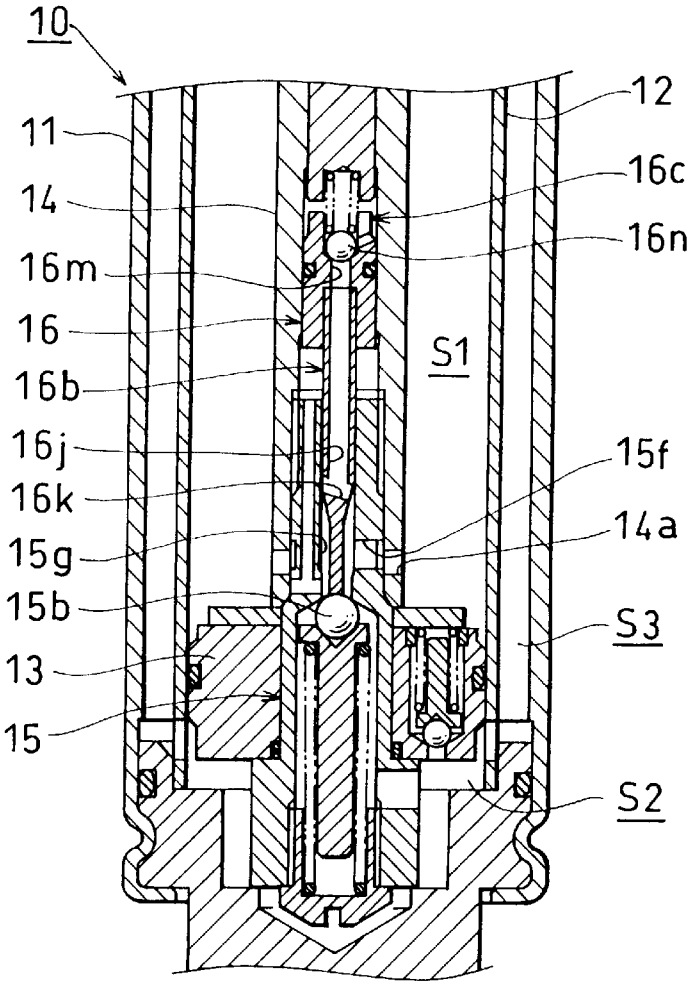
FIGS. 6A and 6B are views (the first half) for explaining an automatic operation of the tilt cylinder device of the invention.
Figure 6A:
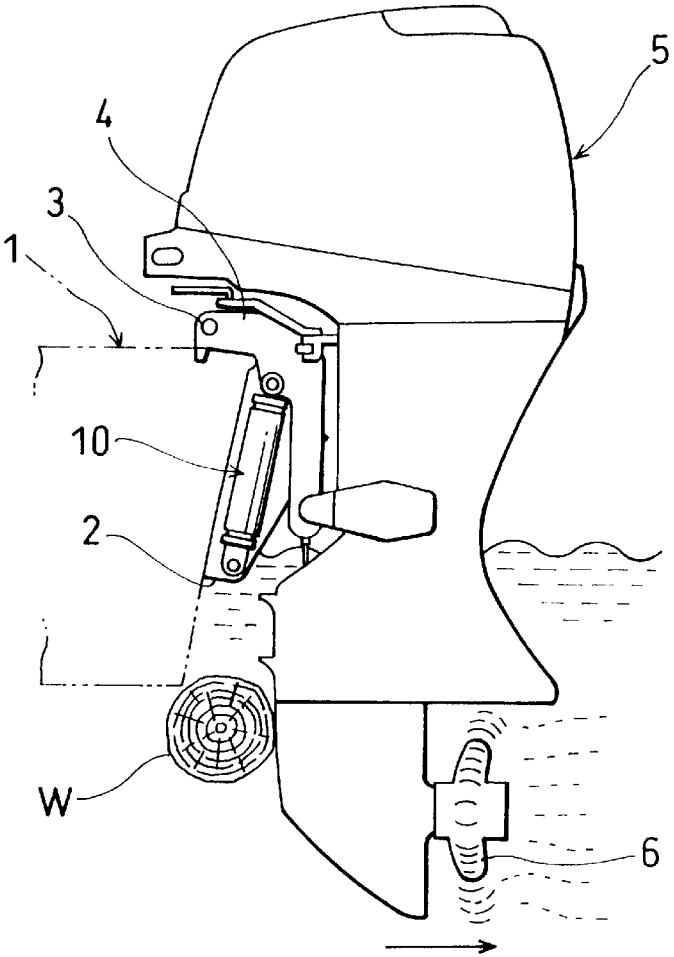

FIGS. 6A and 6B are views (the first half) showing the automatic operation of the tilt lock device of the invention, wherein FIG. 6A shows a state where an external force is applied to the outboard motor, and FIG. 6B shows the result of a pressure change in the upper oil chamber.

Figure 7C:
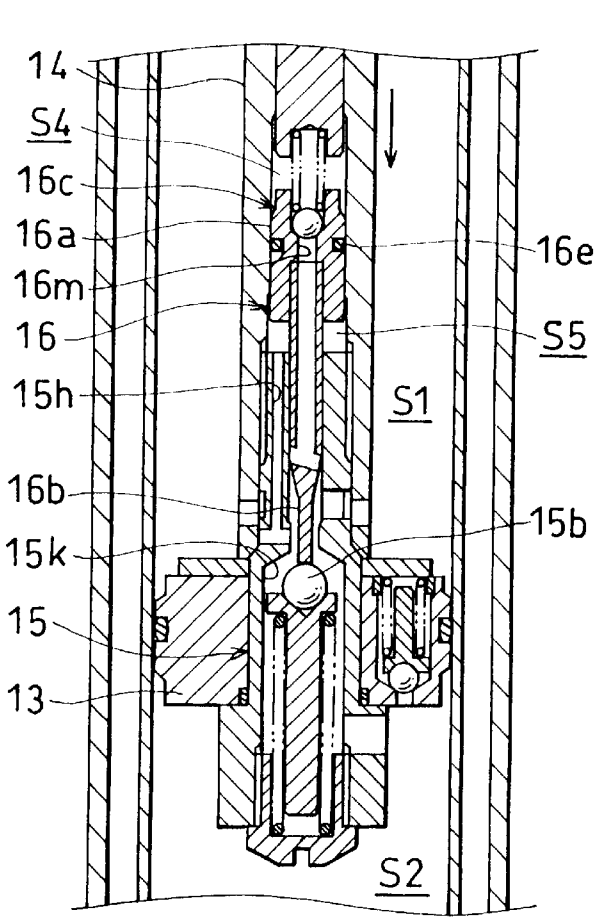
FIGS. 7A to 7C are views (the second half) for explaining the automatic operation of the tilt cylinder device of the invention.
Figure 7B:
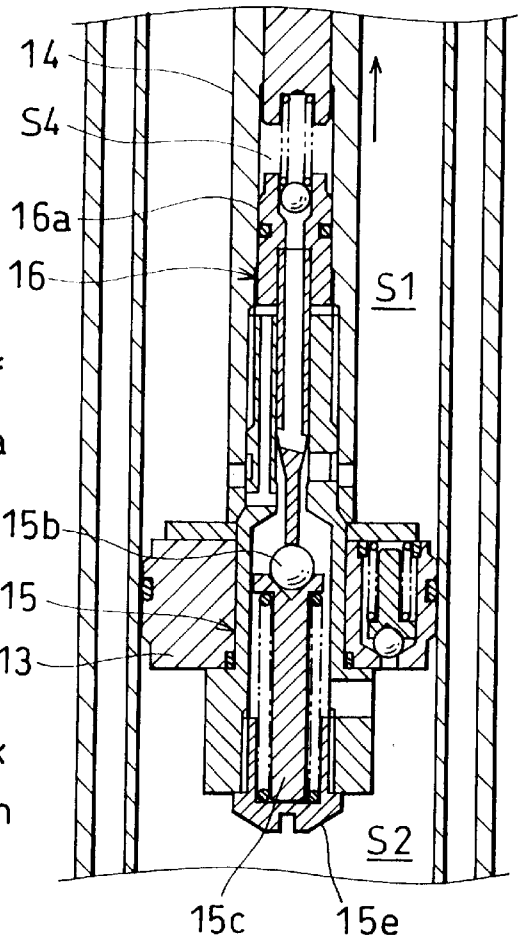
Figure 7A:
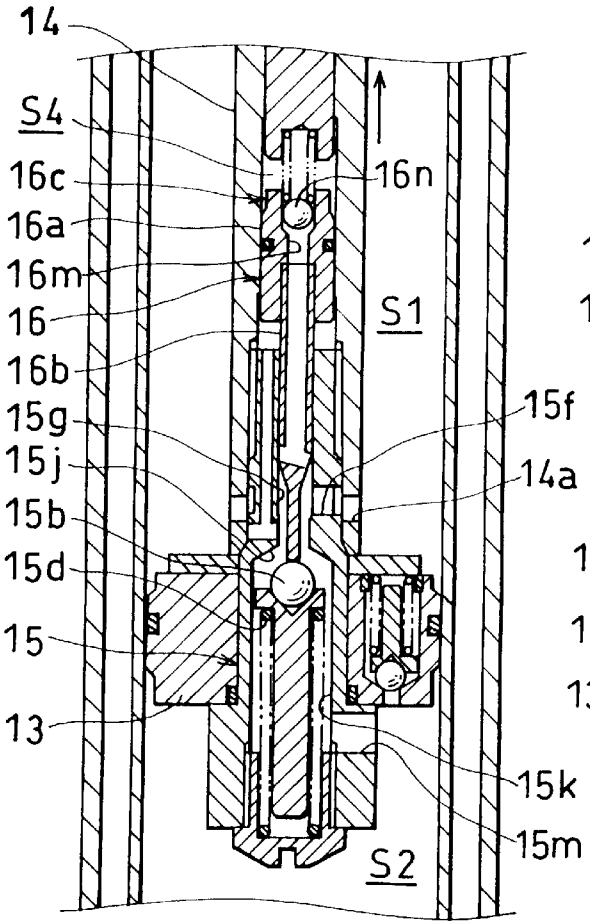

FIGS. 7A to 7C are views (the second half) explaining the automatic operation of the tilt cylinder device of the invention, wherein FIG. 7A shows a state just after the first and third relief valves are opened, FIG. 7B shows a state where the first relief valve is further opened and the free piston is moved downward, and FIG. 7C shows a state where the delay device is operated.

In FIG. 6A, when driftwood or a log W collides against a front portion of the outboard motor 5 during travel, a rearward force is applied to the lower portion of the outboard motor 5, and a tension force is applied to the tilt cylinder device 10.

In FIG. 6B, by the tension force to the tilt cylinder device 10, the piston 13 tends to rise, and pressure in the upper oil chamber S1 is increased.

This pressure is transmitted into the first vertical oil passage 15*g* through the first oil passage 14*a* of the hollow piston rod 14 and the first lateral oil passage 15*f* of the first relieve valve 15 to depress the valve body 15*b*.

Further, this pressure is transmitted to the oil passage 16*m* through the first oil passage 14*a* of the hollow piston rod 14, the first lateral oil passage 15*f* of the first relieve valve 15, the first vertical oil passage 15*g*, the inclined hole 16*k* of the delay mechanism 16 and the vertical opening 16*j* to push up the valve body 16*n* of the third relief valve 16*c*.

In FIG. 7A, if the pressure in the upper oil chamber S1 exceeds a predetermined value, i.e., the value=(a pressure in the lower oil chamber S2)+(a set load of the spring 15*d* of the first relief valve 15)/(a cross section of contact portions of the valve body 15*b* and the valve seat 15*j*), the first relief valve 15 is opened.

If the first relief valve 15 is opened, the piston 13 and the hollow piston rod 14 start rising, and the hydraulic fluid in the upper oil chamber S1 starts flowing into the lower oil chamber S2 through the first oil passage 14*a* of the hollow piston rod 14, the first lateral oil passage 15*f* of the first relieve valve 15, the first vertical oil passage 15*g*, the valve chamber 15*k* and the second lateral oil passage 15*m*.

The pin 16*b* and the free piston 16*a* of the delay mechanism 16 are lowered as the valve body 15*b* is lowered, and the hydraulic fluid in the oil passage 16*m* of the free piston 16*a* pushes and opens the valve body 16*n* of the third relief valve 16*c*, and flows into the upper oil chamber S4 in the rod.

In FIG. 7B, when a shock applied to the outboard motor 5 (see FIG. 6A) is great, the piston 13 and the hollow piston rod 14 further rise, the pressure in the upper oil chamber S1 is further increased, an amount of the hydraulic fluid flowing into the lower oil chamber S2 from the upper oil chamber S1 is increased, the valve body 15*b* of the first relief valve 15 is further lowered, the lowering movement of the valve body 15*b* is stopped at the point where the lower end of the retainer 15*c* touches the lower lid 15*e*, and at the same time, the lowering movement of the free piston 16*a* is stopped.

When the external force to the outboard motor 5 (see FIG. 6A) ceases, FIG. 7C, the piston 13 and the hollow piston rod 14 do not rise further, the pressure in the upper oil chamber S1 is reduced, the pressure in the oil passage 16*m* of the free piston 16*a* is also reduced and therefore, the third relief valve 16*c* is closed.

Although the first relief valve 15 tends to close, the hydraulic fluid in the upper oil chamber S4 in the rod gradually flows into the valve chamber 15*k* through the lower oil chamber S5 in the rod and the second vertical oil passage 15*h* from the orifice provided in the back-up ring 16*e*, the pins 16*b* and the free piston 16*a* which depressed the valve body 15*b* now rise slowly and delay the closing timing of the first relief valve 15.

While the first relief valve 15 is opened, since a compressing force is applied to the tilt cylinder device 10 by a self-weight of the outboard motor 5 (see FIG. 6A), the pressure in the lower oil chamber S2 is increased, and hydraulic fluid flows into the upper oil chamber S1 through the first relief valve 15 from the lower oil chamber S2, and the piston 13 and the hollow piston rod are lowered.

Therefore, in FIG. 6A, when the outboard motor 5 strikes driftwood W, the tilt cylinder device 10 can automatically expand to moderate the shock and to prevent the outboard motor 5 from being damaged.

Further, since the delay mechanism 16 is provided, if a rearward force ceases to be exerted on the outboard motor 5 after the tilt cylinder device 10 expands and the outboard motor 5 is inclined, the tilt cylinder device 10 slowly shrinks by the weight of the outboard motor 5 itself and therefore, the outboard motor 5 can automatically return to the original substantially upright state as illustrated.

Since the first relief valve 15, the delay mechanism 16 and the operation rod 17*d* of the manual operation mechanism 17 are linearly arranged and disposed, the tilt cylinder device 10 can be made very compact. Further, 1) manually opening and closing actions, 2) automatically opening action, and 3) automatically closing action accompanied by a predetermined time delay after the automatically opening action, can be carried out only by the first relief valve 15 and therefore, the number of parts of the tilt cylinder device 10 and a size thereof is minimized.

The operation of the second relief valve 21 will be explained.

Figure 8:
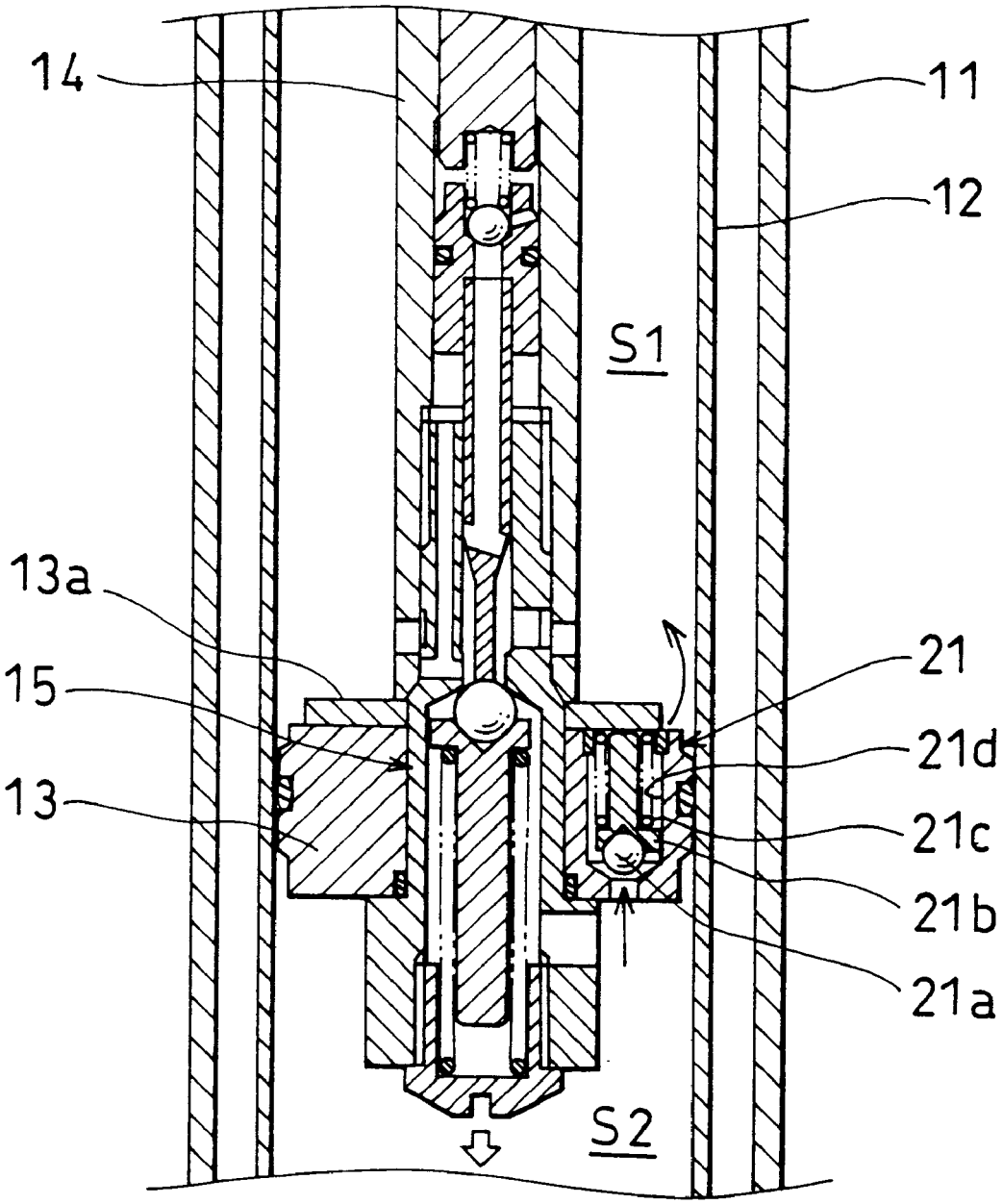
FIG. 8 is a sectional view showing a function of a second relief valve of the invention.

FIG. 8 is a sectional view showing the operation of the second relief valve of the present invention.

A shown in FIG. 5B, in the circumstance where after the boat runs in shallow water with the outboard motor 5 tilted, the boat then advances offshore with the outboard motor 5 being turned substantially vertically and starts normal running as shown in FIG. 1.

At that time, the output of the outboard motor 5 is increased. With this, in FIG. 5B, a forward force of the boat body is applied to the low portion of the outboard motor 5 by the increased driving force of the outboard motor 5.

For this reason, a compression force is applied to the tilt cylinder device 10.

In FIG. 8, the pressure in the lower oil chamber S2 is increased by the compression force of the tilt cylinder device 10, and when a difference in pressure between this pressure and a pressure in the upper oil chamber S1 exceeds a predetermined value, the second relief valve 21 is opened. The hydraulic fluid in the lower oil chamber S2 flows into the upper oil chamber S1 through the valve chamber 21*d* of the second relief valve 21 and an oil passage (not shown). Therefore, the piston 13 is lowered, and the outboard motor 5 shown in FIG. 5B returns to a substantially vertically original state shown in FIG. 1.

Figure 9:
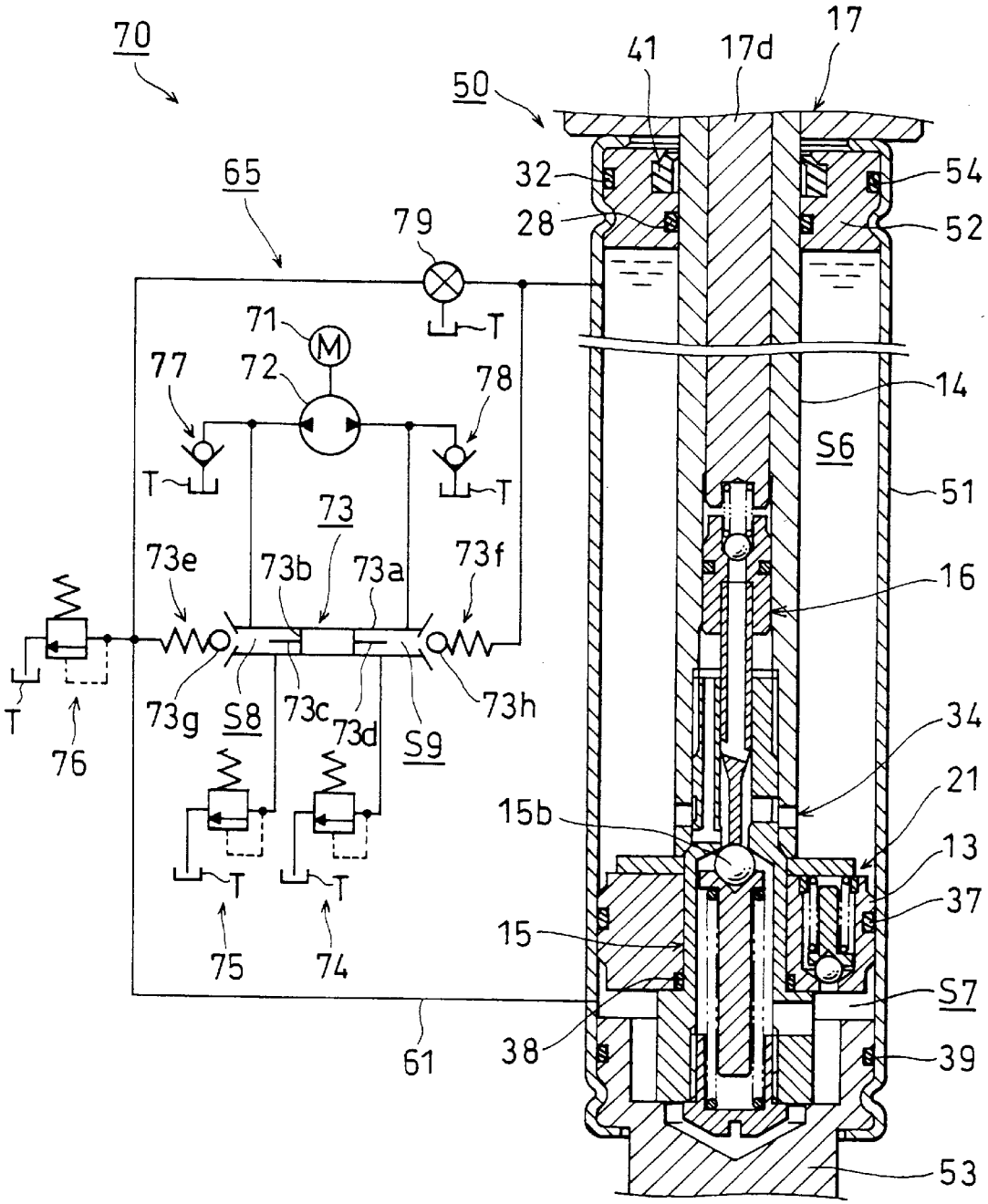
FIG. 9 is a sectional view showing another embodiment of the tilt cylinder device according to the present invention.

FIG. 9 is a sectional view showing another embodiment of the tilt cylinder device according to the present invention. A tilt cylinder device 50 corresponds to the tilt cylinder device 10 shown in FIG. 2 except that the outer and inner cylinders 11 and 12 are formed into a single cylinder, and the air vent valve 24 and the lower block 25 are deleted.

As described above, since the outer and inner cylinders 11 and 12 are formed into the single cylinder, the accumulator S3 is deleted.

Referring to FIG. 9, in the tilt cylinder device 70, the tilt cylinder assembly 50 is formed with an exterior oil passage 61 for bringing oil chambers S6 and S7 (which will be described later) at opposite sides of the piston 13, and a hydraulic pressure generating mechanism 65 is provided in the exterior oil passage 61. Elements similar to those shown in FIGS. 2 and 3 are designated by the same reference numerals, and detail description thereof will be omitted.

The tilt cylinder assembly 50 includes a cylinder 51 in which the piston 13 is movably accommodated, a rod guide 52 for supporting the hollow piston rod 14 at the upper portion in the cylinder 51, a lower block 53 mounted to the cylinder 51, a rod-side oil chamber S6 as a hollow piston rod-side oil chamber defined in the cylinder 51 by the piston 13, and an opposite-side oil chamber S7 as an oil chamber which is opposite from the hollow piston rod and which is also defined in the cylinder 51 by the piston 13. Further, 54 is a O-ring.

The lower block 53 serves as a mounting member for mounting a lower end of the tilt cylinder assembly 50 to the stern bracket 2 (see FIG. 1).

The hydraulic pressure generating mechanism 65 comprises a motor 71, a pump 72 driven by this motor 71 for generating a hydraulic pressure, a control valve 73 for controlling the pressure and the flow direction of hydraulic fluid flowing downstream of the pump 72 to selectively supply the hydraulic fluid to the rod-side oil chamber S6 and the opposite-side oil chamber S7 so as to move the piston 13 toward the rod-side oil chamber S6 or the opposite-side oil chamber S7, safety valves 74 and 75 connected to the control valve 73, a safety valve 76 connected to the exterior oil passage 61, check valves 77 and 78 interposed between the intake side of the pump 72 and the tank T in which the hydraulic fluid is accommodated, and a manual operation valve 79 mounted to the exterior oil passage 61 in parallel to the control valve 73.

The control valve 73 comprises a cylinder portion 73*a,* a spool 73*b* movably inserted into the cylinder portion 73*a,* pins 73*c* and 73*d* mounted to the opposite ends of the spool 73*b,* and valve member 73*c* and 73*f* mounted to the opposite end of the cylinder portion 73*a.* The reference symbols 73*g* and 73*h* denote valve bodies of the valve members 73*e* and 73*f,* respectively, and the reference symbols S8 and S9 denote oil chambers.

The safety valve 74 opens when the pressure in the oil chamber S8 exceeds a set pressure, and the safety valve 75 opens when the pressure in the oil chamber S9 exceeds a set pressure, so as to prevent the control valve 73 from being damaged by an excessive pressure.

The safety valve 76 opens when pressure in the exterior oil passage 61, and the rod-side oil chamber S6 and the opposite-side oil chamber S7 exceed a set pressure, so as to prevent the exterior oil passage 61 and the cylinder 51 from being damaged by an excessive pressure.

The manual operation valve 79 is normally closed, but when the motor 71 or the pump 72 is brought into an inoperative state, the manual operation valve 79 can be opened manually so the rod-side oil chamber S6 and the opposite-side oil chamber S7 can be brought into communication with each other to move the piston 13 upward and downward.

The operation of the above-described tilt cylinder device 70 will be explained next.

Figure 10A:
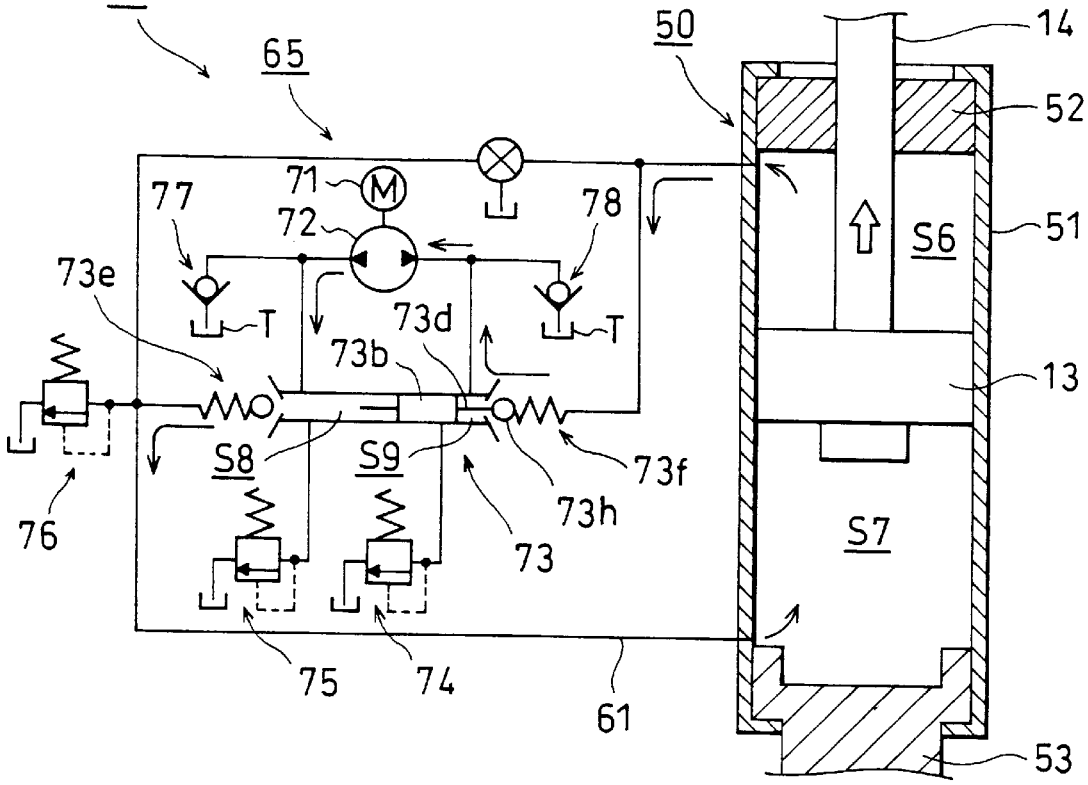
FIGS. 10A and 10B are views showing another embodiment of the tilt cylinder device according to the present invention.
Figure 10B:
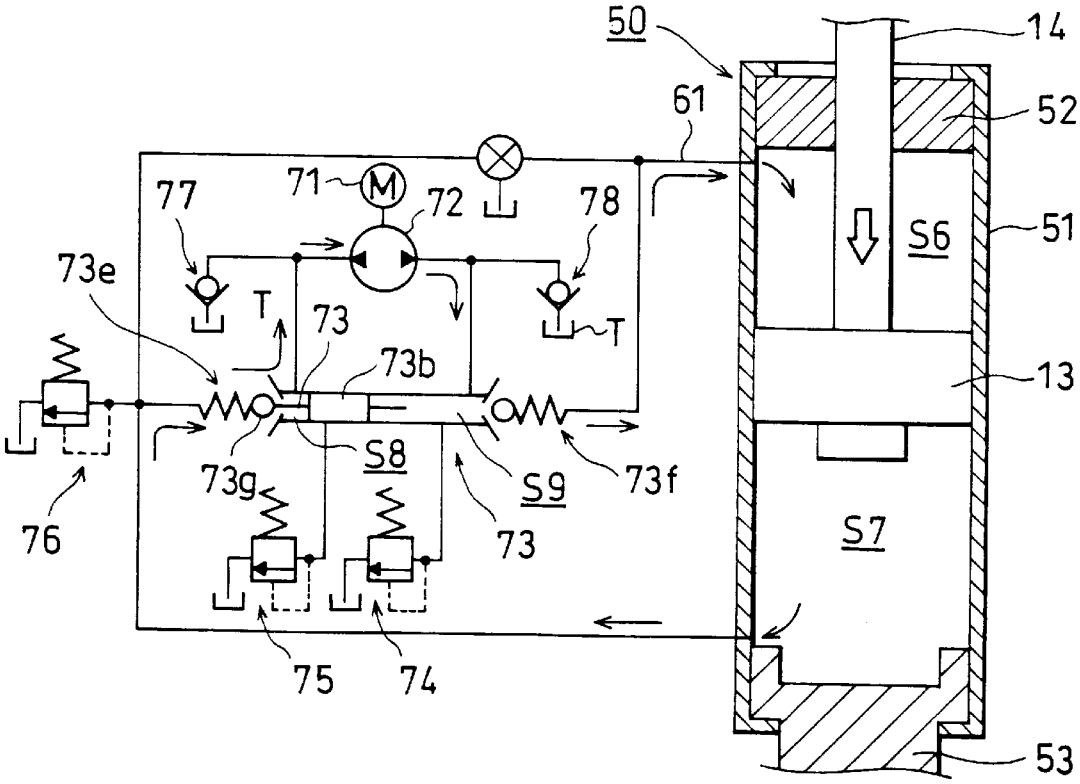

FIGS. 10A and 10B are sectional views showing another embodiment of the tilt cylinder device according to the present invention. FIG. 10A shows the piston moving upward, and FIG. 10B shows the piston moving downward.

To tilt up the outboard motor 5 (see FIG. 5), the pump 72 is first rotated in one direction by the motor 71 in FIG. 10A.

The hydraulic fluid in the tank T flows through the check valve 78 and the pump 72 and reaches oil chamber S8 of the control valve 73 as shown by the arrow so that pressure in the oil chamber S8 is increased.

When the pressure in the oil chamber S8 exceeds the pressure of the valve member 73*e,* the valve member 73*e* opens. As the valve member 73*e* opens, the spool 73*b* of the control valve 73 moves toward an oil chamber S9, and the pin 73*d* pushes the valve body 73*h* of the valve member 73*f* to open the valve member 73*f.*

The hydraulic fluid in the oil chamber S8 passes through the exterior oil passage 61 and reaches the opposite-side oil chamber S7 of the tilt cylinder assembly 50 as shown by the arrow.

Therefore, the pressure in the opposite-side oil chamber S7 is increased, the piston 13 and the hollow piston rod 14 are moved upward, the tilt cylinder assembly 50 is extended, so that the outboard motor 5 (see FIG. 1) is tilted up.

At that time, as the piston 13 moves upwardly, the hydraulic fluid in the rod-side oil chamber S6 of the tilt cylinder assembly 50 passes through the exterior oil passage 61 and the opened valve member 73*f* and returns to the pump 72 as shown by the arrow.

In this case, hydraulic fluid in an amount corresponding to a volume of the hollow piston rod 14 withdrawn from the cylinder 51 additionally flows from the tank T to the pump 72 through the check valve 78 so that the hydraulic fluid is compensated.

To tilt down the outboard motor 5 (see FIG. 1), in FIG. 10B, the pump 72 is rotated in the opposite direction from that shown in FIG. 10A by the motor 71.

The hydraulic fluid in the tank T flows through the check valve 77 and the pump 72 and reaches the oil chamber S9 of the control valve 73 as shown by the arrow so that the pressure in the oil chamber S9 is increased.

If the pressure in the oil chamber S9 exceeds the pressure of the valve member 73*f,* the valve member 73*f* opens. As the valve member 73*f* opens, the spool 73*b* of the control valve 73 moves toward the oil chamber S8, and the pin 73*c* pushes the valve body 73*g* of the valve member 73*e* to open the valve member 73*e.*

The hydraulic fluid in the oil chamber S9 passes through the exterior oil passage 61 and reaches the rod-side oil chamber S6 of the tilt cylinder assembly 50 as shown by the arrow.

Therefore, the pressure in the rod-side oil chamber S6 is increased, the piston 13 and the hollow piston rod 14 are moved downward, the tilt cylinder assembly 50 is shrunk, so that the outboard motor 5 (see FIG. 1) is tilted down.

At that time, as the piston 13 moves downward, the hydraulic fluid in the opposite-side oil chamber S7 of the tilt cylinder assembly 50 passes through the exterior oil passage 61 and the opened valve member 73*e* and returns to the pump 72 as shown by the arrow.

In this case, the hydraulic fluid in an amount corresponding to a volume of the hollow piston rod 14 entering into the cylinder 51 additionally flows from the tank T to the pump 72 through the check valve 77 so that the hydraulic fluid volume is compensated.

The operation of the delay mechanism 16 is the same as that of the embodiment shown in FIGS. 2 and 3 and therefore, a description thereof will be omitted.

As described above, in the tilt cylinder device 70 shown in FIG. 9, the piston 13 from which a hollow piston rod 14 extends in one direction is movably inserted into cylinder 51. The rod-side oil chamber S6 and the opposite-side oil chamber S7 opposite from the rod are defined in the cylinder 51 by the piston 13. The exterior oil passage 61 is provided outside the cylinder 51 for interconnecting the two oil chambers S6 and S7. The pump 72 for generating hydraulic pressure is provided in the exterior oil passage 61. The control valve 73 is also provided in the exterior oil passage 61 for controlling the pressure and flow direction of the hydraulic fluid flowing downstream of the pump 72 to selectively supply the hydraulic fluid to the two oil chambers S6 or S7 so that the piston 13 is moved toward the opposite-side oil chamber S7 or the rod-side oil chamber S6. The communication passage 34 is formed in the piston 13 for interconnecting the two oil chambers S6 and S7. First relief valve 15 which opens when the pressure in the rod-side oil chamber S6 exceeds the set pressure is provided in the communication passage 34. The delay mechanism 16 is provided in the hollow piston rod 14 for delaying the closing operation of the first relief valve 15 by pushing the valve body 15*b* of the first relief valve 15 in its valve opening direction for a predetermined time period after the first relief valve 15 is opened, and the delay mechanism 16 is provided in the hollow piston rod 14. Therefore, it is sufficient if only the hydraulic mechanism 65 comprising the pump 72, the control valve 73 and the like is provided outside the cylinder 51 and therefore, the tilt cylinder device 70 can be made more compact. The freedom for mounting the power tilt cylinder device 70 between the stern 1 and the outboard motor 5 shown in FIG. 1 is enhanced, and the flexibility in design of each of the shapes of the stern bracket 2, the swivel bracket 4 for mounting the opposite ends of the tilt cylinder device 70 (see FIG. 9) as well as the outboard motor 5 is enhanced.

Although the tilt cylinder assembly 50 is upright, and the hollow piston rod 14 is extended upward in the other embodiment of the present invention shown in FIG. 9, the present invention should not be limited to this only, and the tilt cylinder assembly 50 may be disposed upside down. The hollow piston rod 14 may be extended downward, and the tilt cylinder assembly 50 may be disposed horizontally.

The tilt cylinder devices 10 and 70 for the outboard motor of the invention should not be limited to the outboard motor, and it can be employed other hoisting and lowering apparatuses also.

By the above described structure, the present invention exhibits the following effects:

In the tilt cylinder device for an outboard motor according to the present invention, since the delay mechanism is provided in the hollow piston rod, it is sufficient if only the pump and the control valve are provided outside the cylinder, the tilt cylinder device having the hydraulic supply source outside can be made more compact, the freedom for mounting the power tilt cylinder device between the stern and the outboard motor, and the flexibility in design of each of the shapes of the stern bracket, the swivel bracket for mounting the opposite ends of the tilt cylinder device as well as the outboard motor all are enhanced.

Further, in the tilt cylinder device for an outboard motor according to the present invention, since the delay mechanism is provided in the hollow piston rod, the tilt cylinder device having the accumulator chamber can be made more compact, the degree of freedom for mounting the power tilt cylinder device between the stern and the outboard motor, and the flexibility in design of each of the shapes of the stern bracket, the swivel bracket for mounting the opposite ends of the tilt cylinder device as well as the outboard motor all are enhanced.

While the preferred embodiments of the invention have been described in detail with reference to the drawings, they are by no means limitative, and various changes and modifications are possible without departing from the scope and spirit of the invention.

Although the invention has been illustrated and described with respect to several exemplary embodiments thereof, it should be understood by those skilled in the art that the foregoing and various other changes, omissions and additions may be made to the present invention without departing from the spirit and scope thereof. Therefore, the present invention should not be understood as limited to the specific embodiment set out above but to include all possible embodiments which can be embodied within a scope encompassed and equivalents thereof with respect to the feature set out in the appended claims.

What is claimed is:

1. A tilt cylinder device for an outboard motor attachable to a boat stern at selectable arbitrary positions when the motor is swung from its in-use position to its stand-by position, said tilt cylinder device being interposed between the stern and said motor to moderate shock sustained by the motor during running, the device comprising a piston, a hollow piston rod extending in one direction from the piston, a cylinder for movably holding the piston rod, a hollow piston rod-side oil chamber and an opposite-side oil chamber which is opposite from said hollow piston rod-side oil chamber and which are defined in said cylinder by said piston, an exterior oil passage provided outside of said cylinder for bringing said two oil chambers into communication with each other, a pump for said exterior oil passage for generating a hydraulic pressure and a control valve for said exterior oil passage for controlling pressure and flow direction of hydraulic fluid flow downstream of said pump to selectively supply the hydraulic fluid to said two oil chambers to move said piston toward said hollow piston rod-side oil chamber or said opposite-side oil chamber, said piston being formed with a communication passage means for bringing said two oil chambers into communication with each other, said communication passage means being provided with a relief valve which opens when pressure in said hollow piston rod-side oil chamber exceeds a set pressure, and said hollow piston rod being provided with a delay mechanism for delaying closing operation of said relief valve by pushing the body of said relief valve in its valve opening direction for a predetermined time period after said relief valve is opened.

2. A tilt cylinder device for an outboard motor attachable to a boat stern, at selectable arbitrary positions when the motor is swung from its in-use position to its stand-by position, said tilt cylinder device being interposed between the stern and said motor to moderate a shock sustained by the motor during running, the device comprising a piston, a hollow piston rod extending in one direction from the piston, a cylinder for movably holding the piston rod, a hollow piston rod-side oil chamber and an opposite-side oil chamber which is opposite from said hollow piston rod-side oil chamber and which defined in said cylinder by said piston, an accumulator chamber provided outside of said cylinder for also serving as a volume compensating chamber for compensating the volume of oil which flows in and out of said opposite-side oil chamber as said hollow piston rod is advanced or withdrawn, said piston being formed with communication passage means for bringing said two oil chambers into communication with each other, said communication passage means being provided with a relief valve which opens when pressure in said hollow piston rod-side oil chamber exceeds a set pressure, said hollow piston rod being provided therein with a delay mechanism for delaying a closing operation of said relief valve by pushing the body of said relief valve in its valve opening direction for a predetermined time period after said relief valve is opened, and said tilt cylinder device including an exterior operating rod capable of forcibly opening and closing said relief valve through said delay mechanism.

* * * * *